US005671526A

United States Patent [19]

Merlano

[11] Patent Number: 5,671,526

[45] Date of Patent: Sep. 30, 1997

[54] METHOD OF PREPARING TRANSFORMER CORES WITHOUT WASTE

[75] Inventor: Alessandro Merlano, Ceranesi, Italy

[73] Assignee: Tranceria Ligure S.R.L., Italy

[21] Appl. No.: 397,569

[22] Filed: Mar. 2, 1995

[30] Foreign Application Priority Data

Mar. 8, 1994 [IT] Italy ..... GE94A0022

[51] Int. Cl.[6] ..... H01F 3/04

[52] U.S. Cl. ..... 29/609; 336/234

[58] Field of Search ..... 29/415, 602.1, 29/604; 336/216, 217, 234

[56] References Cited

U.S. PATENT DOCUMENTS 4,445,104 4/1984 Lin et al. ..... 29/609

4,711,019 12/1987 Albeck et al. ..... 29/415

4,897,916 2/1990 Blackburn ..... 29/609

5,210,930 5/1993 Watabe et al. ..... 29/609

*Primary Examiner*—P. W. Echols

*Assistant Examiner*—Adrian L. Coley

*Attorney, Agent, or Firm*—Graham & James LLP

[57] ABSTRACT

Fast and economic process to prepare, without waste, E-I or U-I shaped transformer cores consisting of laminations (1, 2–9,10) that are directly stacked during blanking and are permanently jointed by punched zones (5,5'). Each free end of the E (1) or U (9) shaped laminations has a profile, snap-joint matching the profile (4,4') of the lamination in front of it (2,2) so as to permit their rigid fixing. The laminations are obtained from a steel strip (11) using a discontinuous feed cutting machine from one processing station to the next.

7 Claims, 4 Drawing Sheets

METHOD OF PREPARING TRANSFORMER CORES WITHOUT WASTE

This invention covers known E-I or U-I shaped transformer cores obtained from stacked laminations to be assembled after insertion of the coil.

At present, several types of transformer cores are known, consisting of two stacks of laminations, one of which is E or U-shaped whereas the other is I-shaped closes the free ends of the E or U shapes. These E, U or I shaped stacks are obtained by stacking a given number of properly shaped elements cut from a thin steel strip.

Two methods are currently adopted for assembly of these stacks cut from the steel strip, i.e. either by alternating the core laminations or by welding them together.

The first method of alternating the Core laminations, which is most wide-spread used, consists of fitting alternatively a sufficient number of E (or U) shaped and I-shaped laminations at each end of the coil to obtain the transformer. These operations may be either performed manually with much loss of time and possible errors, or with a special machine called a "laminator" at a moderate cost but requiring intensive maintenance, highly skilled operators and perfectly flat transformer steel sheet of constant thickness.

The second assembly method by welding consists in welding the E-I or U-I stacks with expensive machinery operated by highly skilled personnel and high consumption of welding products (gas and electrodes).

Although the costs of equipment, welders and expendable material are high, the latter method allows for a much faster assembly of the cores and is specifically used for the manufacture of medium-large transformers.

A third rigid fixed assembly system is also known by which two laminations having the same shape but turned over by 180° are tightly fitted into each other. Assembly may be by hand at low productivity level or by using expensive automatic machinery at a much better productivity level.

This third core assembly method has, however, a serious drawback since the peculiar shape Of the interpenetrating laminations causes much waste, i.e. a high percentage of scrap.

Another method is known by which the two stacks of E (or U) shaped laminations are assembled by rigid fixing , in particular by fitting the profiled ends of the lateral legs of the E (or U), shapes into matching recesses machined in the opposite end of the I-lamination. It is also known that the various E (or U) shaped and I-shaped core laminations are stacked and assembled by interpenetration so that each lamination features several small lowered shapings forming protuberances at their lower end and recesses at the top, fitting into each other and receiving the corresponding shapings of the upper and lower adjacent laminations.

Various methods are known to cut these laminations from a flat strip with constant thickness, but usually no attention is paid to strip economy, so that much of the steel strip is wasted resulting in scrap that is no longer usable and hence lost. Furthermore, cutting and stacking systems are so far only partially automated and all this entails high costs and great loss of time.

In addition, the core laminations should have standard shapes and sizes to ensure a better distribution of the magnetic flux in the transformer core.

For instance, if S is the width of the lateral legs of the E shape, the width of the central leg should be 2S since it has to support twice the magnetic flux flowing through the lateral legs. Likewise, the width of the E-yoke and of the I shape will be S. It follows that by machining I from inside two opposite E shapes, the free space between the E legs will have a width S. Furthermore, the length 2L of the I shape and the height 2L of the E-shape is exactly twice the length L of the spacing between the two legs of E.

On the other hand, for U-I cores, the width of the U yoke and legs, the width of I and the spacing between the legs will always be S', whereas the length L' of I is the same as the length of the spacing between the legs of the U-shape.

According to U.S. Pat. No. 4,827,237, E and I-shaped core laminations are known by which the I-shapes are machined inside two opposed E-shapes which are then separated. This document specifically discusses profiles shapings machined at the tip of the lateral legs of the E and on the matching side of the I-shapes, so that these protuberances will permit a tight fit of the E-I cores. However, this assembly method of the E-I laminations also causes much loss of material and won't ensure the above mentioned standard sizes. Indeed, when machining the profiles of the I-laminations, the spacing between the E-legs will be greater than S or if the value S is observed for E, I will have a width <S. The fact remains that zones of material will not be utilized between the I profiles and that the spacing between the legs of opposed E-laminations will cause further waste of steel strip.

The patent U.S. Pat. No. 4,827,237 does therefore not permit optimum utilization of the steel strip nor does it ensure an optimum distribution of the magnetic flux. The lack of stable coupling between the central legs of the E-shape and the I lamination is a further drawback, since it will cause vibrations in the transformer core.

The U.S. Pat. No. 4,827,237 system does not mention any automatic cutting and assembly sequences for the E and I-shapes and special equipment for assembly of these laminations is required.

From the patent JP-A-05109549, laminations for transformer cores are known, where the central leg of E is shorter, whereas I is substituted by a T-shape. This solution requires separate cutting of the E-T elements and causes a great amount of scrap. More specifically, that document is concerned with impressions that are suitable for the assembly of various laminations in a stable core without considering any profiles for rigid fixing of the E and T shaped laminations.

Then we should mention JP-A-61035505 regarding the formation of transformer cores with the same E and I-shapes already mentioned in U.S. Pat. No. 4,827,237. In this Japanese document, a partial machining sequence is suggested to obtain these laminations from the strip.

A possible machining sequence is also known from EP-A-0196406 to obtain transformer core laminations. But these U and T-shaped laminations have no assembly profiles and do not comply with the above mentioned standard dimensions.

The document JP-A-59195805 specifies an operating sequence to obtain protuberances by reducing the strip thickness but this sequence cannot be used to produce transformer cores.

Finally, according to GB-A-1543567, a method is described to prepare a set of particularly shaped E and I laminations that are assembled by interpenetration but without observing the above mentioned standard dimensions.

This invention has the aim to prepare E or U and I-shaped transformer cores, virtually without waste of material and such as to observe the standard dimensions that will ensure an optimum magnetic flux, complete sheet cutting sequences resulting in complete stacks ready for core assembly and without need for complex and expensive tools or highly skilled operators. This invention has also the aim to obtain a tight fit between the central legs of the E-shaped and the I-shaped laminations to minimize core vibration.

According to this invention in the case of E and I-shapes, the I-shaped elements are machined from two E-shapes and since the length of each I-shape is equal to the width of the E-shapes, half of the I-shape is obtained from one E-element and the other half is obtained from the other E-shape.

By using proper processing stations, it will be possible to obtain at the same time two E-shaped and two I-shaped stacks from the same steel strip.

In the case of the U and I-shaped laminations, each I-shaped element is obtained from inside the corresponding U-shape, but now the length of the I-shape is equal to the width of the U-shape. The operations required for the manufacture of the stacks are described in detail hereinafter.

The above mentioned E and I or U and I shaped stacks are easily assembled by fitting the narrow profiles of the free ends of the E and U elements into the matching recesses machined into the I-shaped laminations.

Core preparation is therefore immediate, equipment and maintenance are at low cost and may be used by any operator; scrap is almost nihil and the system may be used for both small and large volume transformer production.

The virtual elimination of scrap is due to the particular configuration of the assembly profiles of the E-stacks (or U-stacks) with the I-stacks which, according to this invention are narrow almost semi-circular protuberances and recesses tightly fitting into each other. In the practice, each cut creates a protuberance and a matching recess for assembly.

The scrap resulting from formation of the E-I cores is only limited to the holes bored in one I element whereas the manufacture of the other core causes no scrap. The scrap resulting from formation of the U-I cores is only limited to the recesses machined in the I-laminations.

The invention in question is illustrated in its practical and exemplifying implementation in the attached drawings in which.

Figure 1:
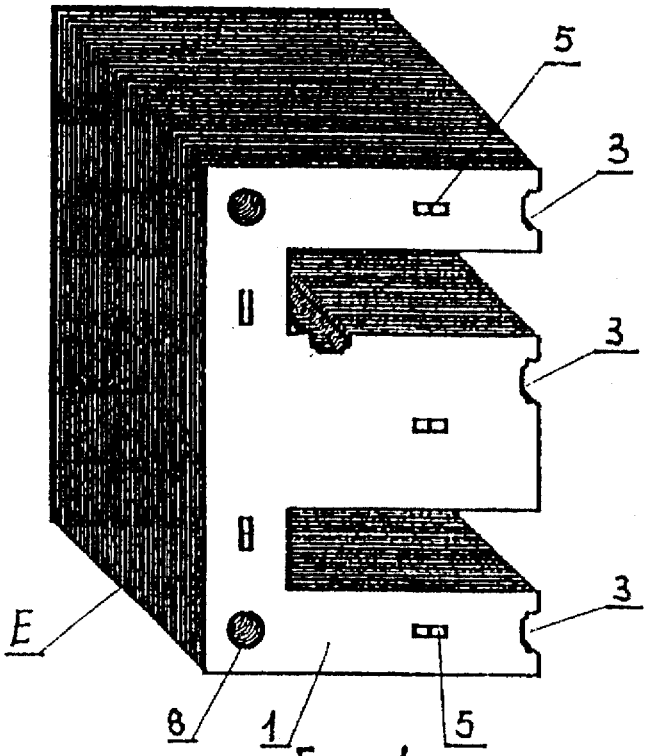
FIG. 1 shows a perspective view of the E stack of the transformer core.
Figure 2:
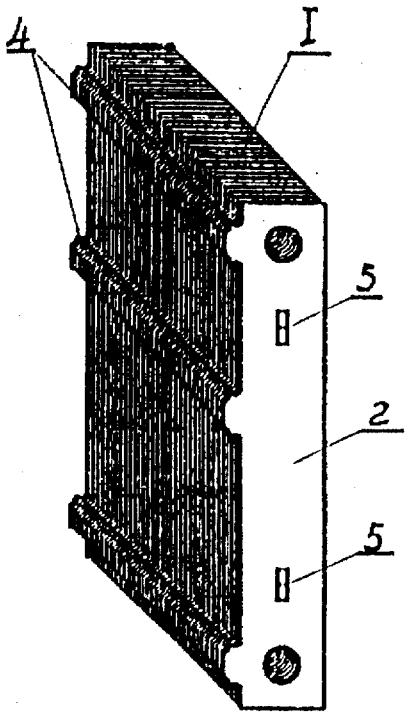
FIG. 2 shows a perspective view of the I stack to be assembled with the E stack in FIG. 1.
Figure 3:
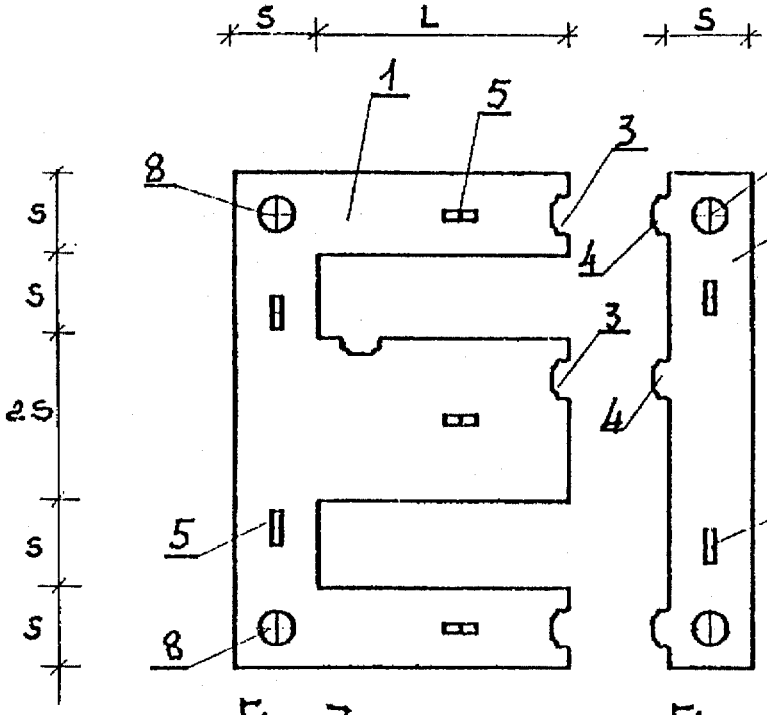
FIGS. 3 and 4 show a top view of an E and I shape as illustrated in FIGS. 1 and 2.
Figure 4:
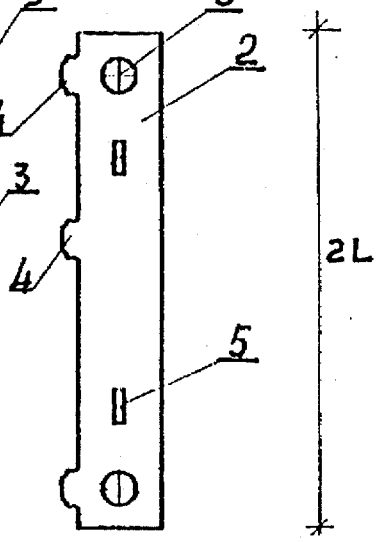
Figure 5:
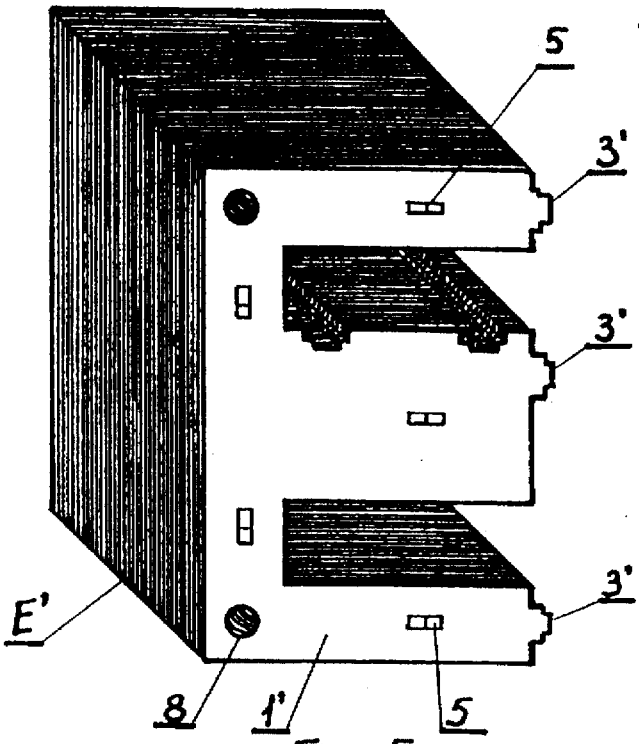
Figure 6:
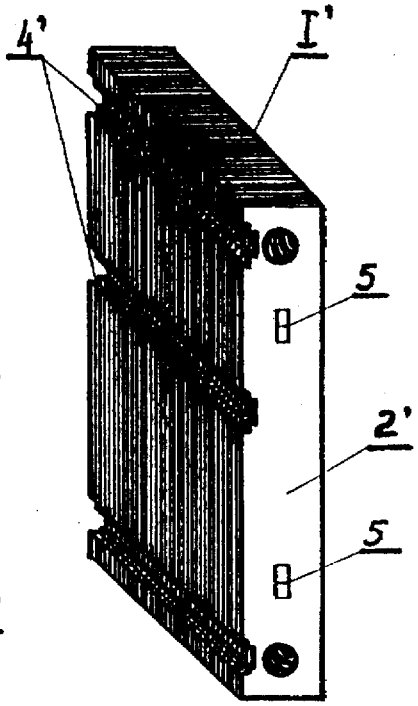
Figure 7:
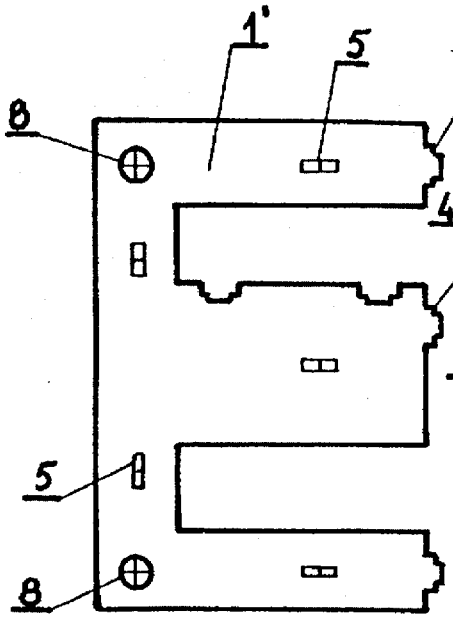
Figure 8:
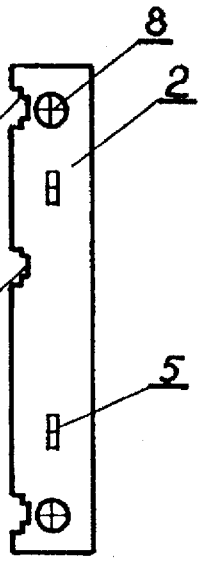
Figure 9:
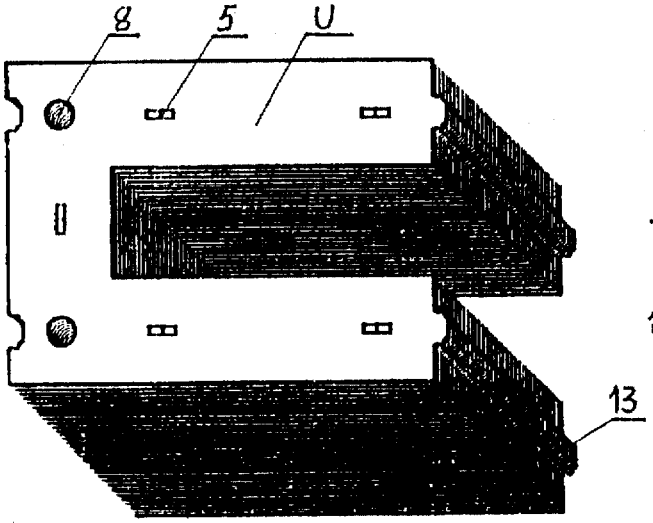
Figure 10:
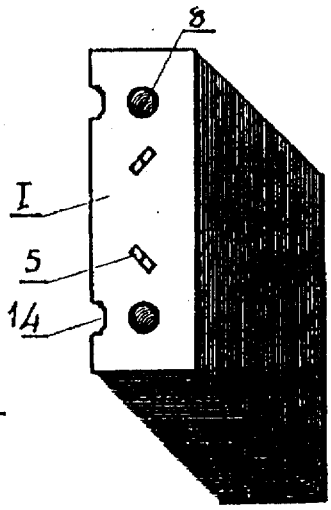
Figure 11:
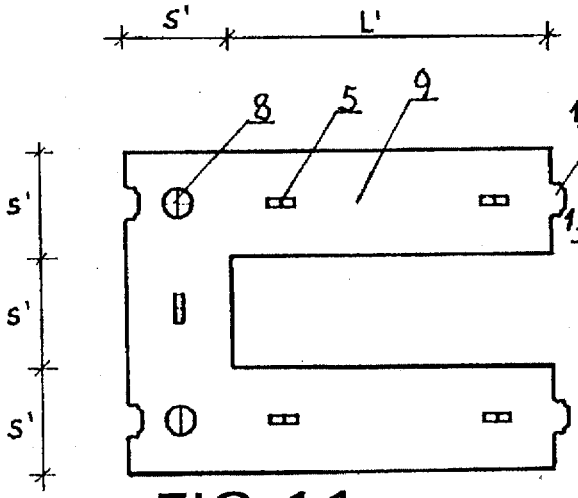
Figure 12:
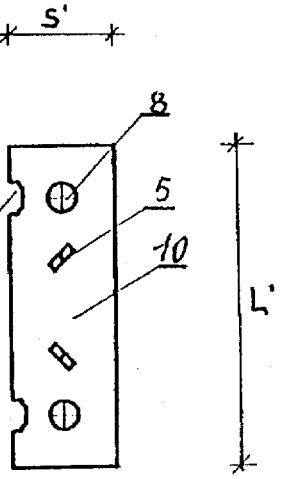
Figure 13:
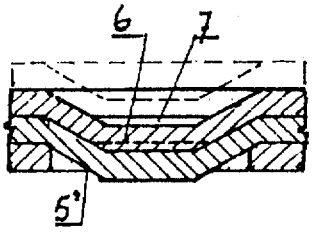
Figure 14:
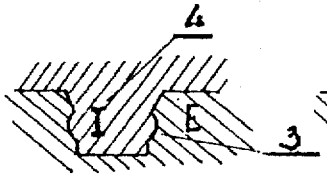
Figure 15:
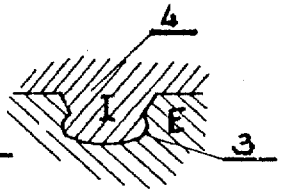
Figure 16:
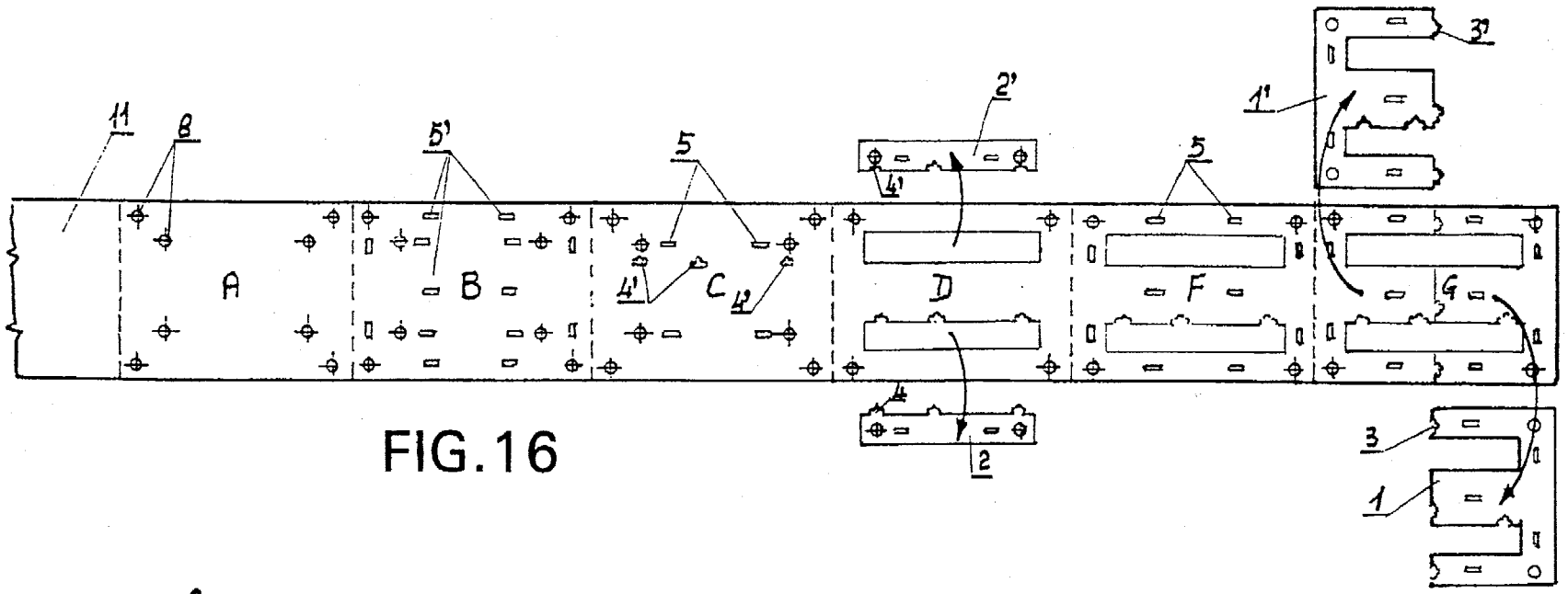
Figure 17:
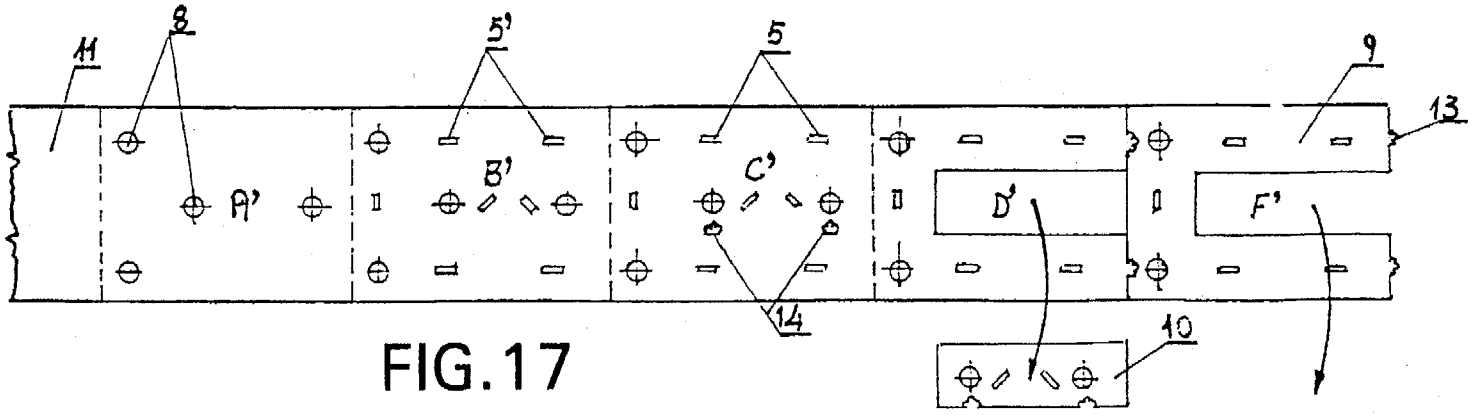

FIGS. 5 6, 7 and 8 respectively show the figures corresponding to 1,2,3 and 4 illustrating the second E', I' stacks;

FIGS. 9 and 10 respectively show a perspective view of the U and I stacks to be assembled;

FIGS. 11 and 12 respectively show a top view of U-shaped and I-shaped laminations illustrated in FIGS. 5 and 6;

FIG. 13 shows a magnified vertical section of the snap assembly system of the stacked laminations;

FIGS. 14 and 15 show a horizontal section of the two assembled E, E' (or U) and I, I' shapes;

FIG. 16 shows the operating sequence for preparation of the E and I stacks from one single strip according to this invention;

FIG. 17 shows the operating sequence for preparation of the U and I stacks from one single strip according to this invention.

With reference to the FIGS. 1 thru 4, the E-I core consists of a stack of E-shaped laminations 1 and a stack of I-shaped laminations 2. These two stacks contain the same number of laminations 1 and 2.

Each E-shaped lamination 1 has a proper recess at its free ends, whereas each I-shaped lamination 2 features protuberances 4 fitting into the recesses 3.

The protuberances 3 and recesses 4 are snap jointed for assembly of the laminations 1 and 2 and of the E and I-shaped stacks after the coil (not shown in the drawing) has been inserted. The FIGS. 14 and 15 show an example of the profiles of these protuberances and recesses after assembly of the E and I-shaped stacks which may of course also have any other configuration.

Similarly as shown in the FIGS. 5 thru 8, the second core E'–I' is built up of E-shaped laminations 1' and I-shaped laminations 2'. These E-shaped laminations 1' feature protuberances 3', whereas the I-shaped laminations 2' have recesses 4' to permit snap jointing of the E' and I' stacks. This possibility to obtain stacks featuring 3,4 or 3',4' profiles will facilitate the preparation of the cores without waste as will be explained below.

In short, the profiles 3, 4–3',4' are of the utmost importance for this Patent. The profiles are very narrow and button-shaped for snap connection as shown for exemplification in FIGS. 14, 15.

The profiles 3,3' of the E, E' laminations are obtained simply by cutting along the line separating the two opposed legs of the E, E' laminations, this operation will cause no scrap. The profile 4 of an I lamination is obtained by blanking it out from inside the two opposed E elements and this operation will form small recesses in the E legs without any waste. Finally to obtain the recesses 4' in the other I-shape, it suffices to punch the strip at recess level and these punchings will cause the only scrap in the whole process according to this invention.

Each E-shaped lamination 1 and each I-shaped lamination 2 will have numerous and variously located punched zones that will be useful for assembly of the laminations 1,2 so as to form the related stacks. Punching will form lateral slots and will cause lowering of a very thin strip 6 having a height slightly greater than the thickness of the lamination. As can be seen in FIG. 13, the lowered strips 6 of the upper laminations pass through the lateral walls 7 of the slots in the underlying laminations causing their nesting by lateral friction.

The bottom lamination of each stack has only an open slot 5' that will receive the lowered strip 6 of the superimposed lamination.

Holes 8 will also be punched in the E-shaped laminations 1,1' and in the I-shaped laminations 2,2' for additional bolting of the stacks according to a known method.

The FIGS. 9 thru 12 refer to the preparation of U and I shaped stacks for U-I transformer cores. These U-I stacks are prepared in the same way as described for E-I stacks.

The U-shaped element bears the reference number 9, the I-shape is indicated by 10, while the parts that are the same as in the previous solution are identified by the same reference numbers.

It may be observed that in this case too, the protuberances 13 in the U and the recesses 14 in the I-shapes for U-I assembly are directly machined with very little waste limited to the I recesses only.

Operations for the preparation of the EI and E'-I' stacks illustrated in the FIGS. 1 thru 8 are sequenced by a machine schematically outlined in FIG. 16, so that each process station will machine at the same time two E-shaped and two I-shaped laminations. The core strip 11 having a length L equal to the height of the core, enters the machine and progressively passes through the various stations A,B,C,D, F,G at discontinuous feed.

The holes 8 are drilled in the first station A, while in station B, the slots 5' are punched in the bottom lamination of the E-I and E'-I' stacks (this being the first to be punched);

this second station B is therefore only used for the first couple of E-shapes 1,1' and I-shapes 2,2' and is skipped for punching of all other laminations in the stack.

The third station C provides for punching of the thin strips 5 of the I-shapes 2,2' and for removal of the recessed zone 3' in the second I-shape 2'.

The two I-shaped laminations 2,2' are blanked in the fourth station D, one of which will feature protuberances 4 and the other recesses 3'; the laminations 2,2' will drop in a zone where they are separately stacked and fitted into each other by means of the punched zones 5. After stacking, the I-shaped blocks are ready for use.

The nesting strips 5 of the E-shaped laminations 1,1' are punched in the fifth station F. Finally, in the sixth station G, the two E-shaped laminations 1-1' are separated and dropped in a zone where they are separately stacked and snap-assembled, ready for use. One of these stacks features protuberances 3' whereas the other has recesses 3 for snap assembly with their matching I-blocks 2,2'.

It follows that two stacks of E-shaped laminations 1,1' and of two I-shaped laminations 2,2' are obtained by this processing sequence. After the coils are introduced, these two stacks may be snap-assembled because of their 3,4 or 3'4' profiles. Assembly is very easy both by hand or by an automatic machine.

Core preparation thus becomes simple and linear at low machine and labour cost. Waste is limited to the small amount of scrap resulting from punching the recesses 4' in the I-shapes, while everything else is used for core formation.

The operation sequence for preparation of the U-I cores is shown in FIG. 17 and is the same as described for E-I cores except for the fact that only one U-shaped lamination 9 and one I-shaped lamination 10 is prepared. In detail, the holes 8 are drilled in station A', the slots 5' in the bottom laminations are punched in station B', the recesses 4 and punchings 5 in the U-shapes 9 and I'-shapes 10 are completed in station C', the I-shapes 10 are cut and stacked in station D', whereas in station F' the U-shaped laminations 9 are cut from the strip and provided with protuberances 13 and stacked with the others.

Thus, two U-I shaped stacks are obtained that are snap assembled by the profiles 13,14 after the coil has been inserted.

The advantages described for the E-I cores are also valid for the U-I shapes.

Obviously, the operations, performed in the above described processing stations for E-I and U-I core preparation may somewhat vary and some operations may be transferred from one station to another one or may be incorporated in the same station.

It follows that the method according to this invention offers the following benefits:

- the cost of the core virtually equals the cost of the strip from which the core is obtained;
- there are no surplus E or I-shaped elements since both are blanked at the same time;
- there is no waste material due to warped, curved or other discarded laminations;
- no expensive equipment or machinery is needed;
- assembly time is greatly reduced;
- no qualified labour is required
- the system is extremely profitable for small series as well as for large production volumes;
- Standard dimensions are observed to optimize the magnetic flux in the cores;
- all three legs of the E-shapes are snap fastened to the I-shapes to minimize vibration during operation.

I claim:

1. A method for the preparation of E-I transformer cores, with minimized waste, wherein the transformer cores comprise lamination stacks of blankings from a steel sheet, in the form of co-fitting E-I elements, with each of the E elements comprising two outer and one central co-extensive parallel horizontal legs interconnected with a vertical element, said method comprising the steps of:

a) forming a blanking in the form of two E elements of substantially equal height, integrally connected to each other at the respective free ends of their three parallel legs, with the vertical elements of the two E elements being parallel and wherein the distance between the vertical elements is substantially equal to the height of the E elements;

b) removing first and second I elements from the blanking from which the connected two E elements are formed, with a first I element being removed from and comprising the area of the blanking longitudinally defined by the parallel vertical elements of the two connected E elements and laterally defined by adjacent connected central and a first pair of outer legs, and with the second I element being removed from and comprising the area of the blanking longitudinally defined by the parallel vertical elements of the two connected E elements and laterally defined by adjacent central and the other of the connected outer legs; and c) separating the E elements to obtain two pairs of E-I elements; and d) forming the E-I transformer core from the pairs of E-I elements;

wherein the improvement comprises providing each pair of E-I elements with interconnection means between the E and I element thereof, with said interconnection means comprising snap co-fitting protuberances and recesses at the free ends of one or more of the E element and in a cofitting side of the I element, wherein protuberances are formed in the E element legs by forming a co-fitting recess in the adjacent legs of the other E element, with the separation of the E elements; and wherein protuberances in the I elements are formed by forming a co-fitting recess in an E element leg during forming and removal of the I element from the blanking adjacent thereto, and wherein recesses are formed in an I element by removal of material therefrom.

2. The method of claim 1 wherein the outer legs of each of the E elements are of the same width and wherein the central leg of the E elements have a width exactly twice that of the outer legs.

3. The method of claim 1, wherein the steel sheet has a width equal to the height of the E elements.

4. The method of claim 1, wherein a first E element is formed with a protuberance at each of the free ends of the legs thereof and the other of the E elements is thereby formed with a co-fitting recess at each of the free ends of the legs thereof; and wherein a first I element is formed to comprise three recesses adapted to be snap fit engaged with the protuberances of the first E element and wherein the other of the I elements is formed with three protuberances which are adapted to be snap fit engaged with the recesses of the other of the E elements, wherein the protuberances of the other of the I elements are formed from an adjacent leg of an E element in step b), and wherein material removed in the forming of the recesses of the first I element substantially comprises the only waste of the blanking.

5. A method for the preparation of U-I transformer cores, with minimized waste, wherein the transformer cores comprise lamination stacks of blankings from a steel sheet, in the form of co-fitting U-I elements, with each of the U elements comprising two co-extensive parallel horizontal legs interconnected with a vertical element, said method comprising the steps of:

a) forming a blanking in the form of one or more sets of two U elements integrally serially connected to each other, with the respective free ends of the parallel legs of one U element being integrally connected with the vertical element of the other U element, whereby respective vertical elements of the U elements are parallel and wherein the distance between the vertical elements is substantially equal to the height of the U elements;

b) removing I elements from the blanking from which the connected two U elements are formed, with each of the I elements being removed from and comprising the area of the blanking longitudinally defined by the parallel vertical elements of two connected U elements and laterally defined by the parallel legs of a U element; and c) separating the U elements to obtain pairs of U-I elements; and d) forming the U-I transformer core from the pairs of U-I elements;

wherein the improvement comprises providing each pair of U-I elements with interconnection means between the U and I element thereof, with said interconnection means comprising snap cofitting protuberances and recesses at the free ends of the U element and in a cofitting side of the I element, wherein protuberances are formed in the U element legs by forming a co-fitting recess in the adjacent vertical element of the other U element, with the separation of the U elements; and wherein protuberance in the I elements are formed by forming a co-fitting recess in the leg of the U element during forming and removal of the I element from the blanking adjacent thereto and wherein recesses are formed in the I element by removal of material therefrom.

6. The method of claim 5, wherein the steel sheet has a width equal to the height of the U elements.

7. The method of claim 5, wherein a first U element is formed with a protuberance at each of the free ends of the legs thereof and the other of the U elements is thereby formed with a co-fitting recess in the vertical element thereof; and wherein a first I element is formed to comprise two recesses adapted to be snap fit engaged with the protuberances of a U element and wherein material removed in the forming of the recesses of the I element substantially comprises the only waste of the blanking.

* * * * *